US011753050B2

(12) United States Patent
Hintermeir

(10) Patent No.: US 11,753,050 B2
(45) Date of Patent: Sep. 12, 2023

(54) ASCENT AID ON A RAIL VEHICLE

(71) Applicant: SIEMENS MOBILITY GMBH, Munich (DE)

(72) Inventor: Stefan Hintermeir, Aschau I.Ch (DE)

(73) Assignee: Siemens Mobility GmbH, Munich (DE)

( * ) Notice: Subject to any disclaimer, the term of this patent is extended or adjusted under 35 U.S.C. 154(b) by 390 days.

(21) Appl. No.: 17/267,069

(22) PCT Filed: Jul. 15, 2019

(86) PCT No.: PCT/EP2019/069031

§ 371 (c)(1),
(2) Date: Feb. 9, 2021

(87) PCT Pub. No.: WO2020/035247

PCT Pub. Date: Feb. 20, 2020

(65) Prior Publication Data

US 2021/0309266 A1 Oct. 7, 2021

(30) Foreign Application Priority Data

Aug. 15, 2018 (DE) ..... 102018213727.7

(51) Int. Cl.
*B61D 23/02* (2006.01)

(52) U.S. Cl.
CPC ..... *B61D 23/025* (2013.01); *B61D 23/02* (2013.01)

(58) Field of Classification Search
CPC ..... B61D 23/025; B61D 23/02; B60R 3/02; A61G 3/068
See application file for complete search history.

(56) References Cited

U.S. PATENT DOCUMENTS

| | | | | |
|---|---|---|---|---|
| 3,371,623 A | | 3/1968 | Therrien | |
| 4,623,160 A | * | 11/1986 | Trudell | B60R 3/02 182/127 |
| 4,720,116 A | * | 1/1988 | Williams | B60R 3/02 182/127 |
| 8,556,283 B2 | * | 10/2013 | Coochesfahani | B60R 3/02 105/449 |
| 9,944,231 B2 | * | 4/2018 | Leitner | B60R 3/02 |

FOREIGN PATENT DOCUMENTS

| | | | |
|---|---|---|---|
| DE | 2129223 | A1 | 12/1972 |
| DE | 102013017573 | A1 | 4/2015 |
| DE | 102016114269 | A1 | 12/2017 |
| EP | 0114264 | A2 | 8/1984 |

* cited by examiner

*Primary Examiner* — Mark T Le
(74) *Attorney, Agent, or Firm* — Laurence A. Greenberg; Werner H. Stemer; Ralph E. Locher

(57) ABSTRACT

An ascent aid on a rail vehicle having a vehicle body includes a step and at least one folding mechanism fastened to the step at one end, as seen in longitudinal direction of the step. The folding mechanism has two lateral rods connecting the step to the vehicle body at hinges. The folding mechanism has a connecting rod additionally connecting one of the lateral rods to the vehicle body at hinges. The connecting rod is split into two parts by a folding hinge. The folding hinge is coupled to an action of force on the folding hinge causing the step to be folded at the hinges between first and second positions relative to the vehicle. In the first position, an ascent to a driver's cab of the vehicle is assisted. In the second position, the step is folded to maintain a predetermined clearance gauge of the vehicle.

6 Claims, 6 Drawing Sheets

ASCENT AID ON A RAIL VEHICLE

BACKGROUND OF THE INVENTION

Field of the Invention

The invention relates to an ascent aid on a rail vehicle, with a step and with two lateral rods, wherein the rail vehicle has a vehicle body, and the step is arranged laterally on the vehicle body in the longitudinal direction.

Rail vehicles, such as traction units and control cars, have a driver's cab from which the rail vehicle is controlled. The driver's cab is arranged at a very high location in the rail vehicle to ensure an optimum view of the track system. In order to be able to reach the driver's cab, steps are arranged on the outer side of the rail vehicle as an ascent or descent aid, the steps being provided for connecting the driver's cab to the track level. The steps are arranged along a vertical line and thus have the comparable function of a vertical ladder.

Occupational accident prevention regulations result in the steps having large step surfaces. In addition, hand rails are provided at the side of the ladder in order to enable the rail vehicle driver to safely climb up and down the rail vehicle. Steps and hand rails thus form components of the ladder or of the ladder functionality.

Dimensions and positions of the steps together with hand rails are defined in standards and are therefore mandatory.

The hand rails and/or steps protrude outward in an exposed manner with respect to the outer side of the rail vehicle and are limited in position and size by a clearance gauge of the rail vehicle that is likewise to be maintained.

The clearance gauge is defined perpendicular to the longitudinal axis of the rail vehicle and is a measure of the cross section of the rail vehicle. It tapers in the lower region in the direction of the track body. This gives a secure region between the ladder components, on the one hand, and the track body, on the other hand, that is to be kept free and that takes into consideration the circumstances of the track body (for example signal transmitters, such as beacons, point machines, etc.) and thus avoids collisions in the operative (driving) mode of the rail vehicle.

The position of the lowermost step and the position of the ends of the holding rods are thus determined on the rail vehicle by the clearance gauge that is to be maintained; the lowermost step is thus arranged at a predetermined height on the rail vehicle. Said predetermined height of the lowermost step has to be overcome by a rail vehicle driver who is, for example, on the track body, by means of a long-reaching step in the vertical direction.

Increasing safety and comfort awareness of track operators is increasingly leading to the requirement of arranging a further step usable as a way up on the rail vehicle. Said step is intended to be arranged corresponding to the above description between the track body and the predetermined height, but is available only while the vehicle driver is climbing up or down. In the operative (driving) mode of the rail vehicle, the predetermined clearance gauge is intended to be kept free, and therefore solutions with a movably designed lowermost step are known.

For example, the publication DE 10 2016 114 269 A1 discloses a pivoting step which has a step held on two arms and a drive for pivoting the arms about a common pivot axis. The drive is used to move the step from a retracted position into an extended position, and vice versa.

FIG. 6 also shows a further known solution for an improved ascent ladder by reference to a SKODA, series BR

102, locomotive. The lowermost ascent step is configured here so as to be extendable and retractable in the vertical direction.

Further ascent aids or steps with different configurations are known from the publications U.S. Pat. No. 3,371,623 A, DE 1 0201 301 7573 A1, DE 2129223 A1 and EP 01 14264 A2.

SUMMARY OF THE INVENTION

It is the object of the present invention to specify a further solution for an ascent aid or descent aid on a rail vehicle permitting the rail vehicle driver to easily and safely reach or leave the driver's cab.

This object is achieved by the features described below.

Advantageous developments are specified in the further claims.

The invention relates to an ascent aid on a rail vehicle which has a vehicle body, with a step and with at least one folding mechanism. The folding mechanism, as seen in the longitudinal direction of the step, is fastened to the step at one end thereof. The folding mechanism has two lateral rods which connect the step to the vehicle body via hinges. The folding mechanism has a connecting rod which additionally connects one of the lateral rods to the vehicle body via hinges. The connecting rod is split into two parts by a folding hinge. The folding hinge is coupled to an action of force in such a manner that the action of force on the folding hinge causes the step to be folded via the hinges between a first position and a second position with respect to the rail vehicle. In the first position of the step, an ascent to a driver's cab of the rail vehicle is assisted. In the second position, the step is folded in such a manner that a predetermined clearance gauge of the rail vehicle is maintained.

In a preferred development, a first folding mechanism, as seen in the longitudinal direction of the step, is fastened to the step at a first end thereof.

In a preferred development, a second folding mechanism, as seen in the longitudinal direction of the step, is fastened to the step at a second end thereof that is opposite the first end of the step.

In a preferred development, the two lateral rods of the folding mechanism are connected at the respective lower ends via respective hinges to the step. In addition, the two lateral rods are connected at their respective upper end via respective hinges to the vehicle body.

In a preferred development, the first folding mechanism comprises a cylinder which, for the action of force, is connected at one end to the folding hinge of the associated connecting rod and at the other end to the vehicle body. Said cylinder, in the first position, with the step unfolded, is extended such that the connecting rod has a bend. The cylinder, in the second position, with the step folded in, is retracted such that the connecting rod is straightened, in order to lock the folding mechanism in this second position.

In a preferred development, the second folding mechanism comprises a cylinder which, for the action of force, is connected at one end to the folding hinge of the associated connecting rod and at the other end to the vehicle body. Said cylinder, in the first position, with the step unfolded, is retracted such that the connecting rod is straight, in order to lock the folding mechanism in this first position. The cylinder, in the second position, with the step folded in, is extended such that the connecting rod has a bend.

In a preferred development, because of the action of force on the folding hinge, the step is mounted so as to be foldable in a movement plane transversely with respect to the longitudinal direction of the rail vehicle.

In a preferred development, in the event of a drop in pressure in the cylinders, the latter are connected and configured in such a manner that the step is rotated into the second position.

In a preferred development, the rotation into the second position after the drop in pressure is realized with a time delay.

In a preferred development, the cylinders are part of a pneumatic or hydraulic or electric cylinder system.

In a preferred development, a hand rail is arranged on the rail vehicle, said hand rail assisting the safe ascent of operating staff to the driver's cab. The hand rail comprises an integrated actuating mechanism with which the action of force is controlled.

In a preferred development, the step is mechanically blocked both in the first position and in the second position by action of force on the folding hinge in conjunction with a stop which is arranged on the folding hinge.

The present invention can be realized in the rail vehicle without implementation in the rail vehicle software. Validations in conjunction therewith are therefore dispensed with.

The present invention can be implemented cost-effectively in the rail vehicle.

The present invention ensures secure locking of the step in a predetermined position on the rail vehicle even in the event of a drop in pressure, in order to ensure the (driving) mode of the rail vehicle.

The present invention is described in more detail below by way of example with reference to drawings.

DETAILED DESCRIPTION OF THE INVENTION

Figure 1:
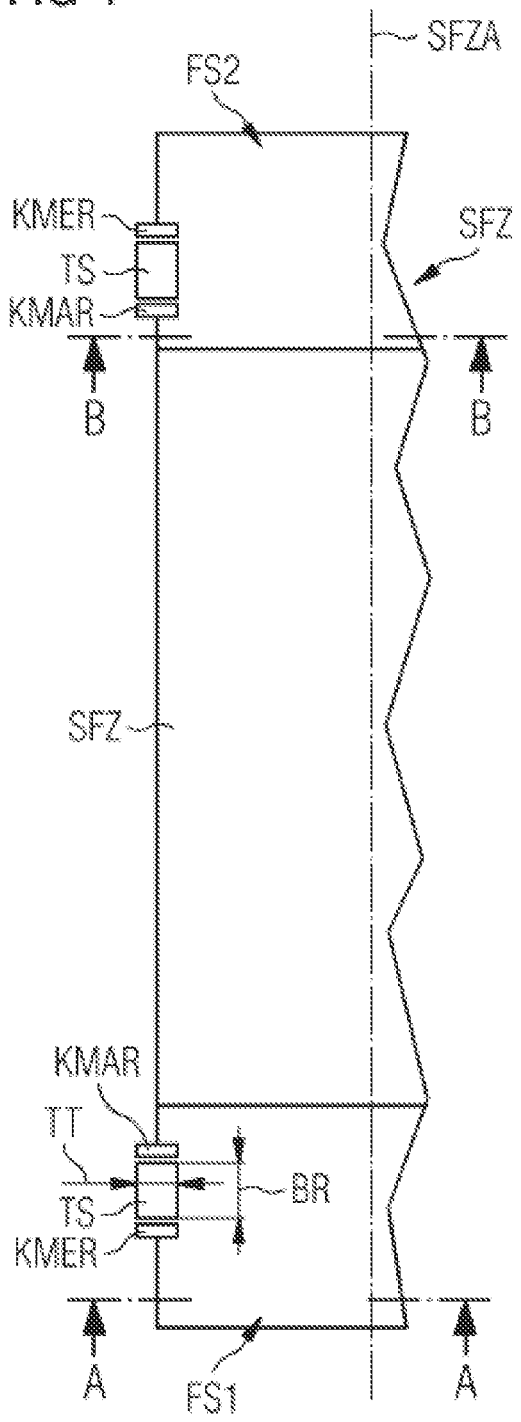
FIG. 1 shows a top view of a rail vehicle with an ascent aid according to the invention in a partial illustration.

FIG. 1 shows a top view of a rail vehicle SFZ with an ascent aid according to the invention in a partial illustration.

The rail vehicle SFZ is illustrated here lengthwise, but only over half the length. It comprises a respective driver's cab FS1 and FS2 at each end.

Each driver's cab FS1, FS2 is respectively provided with two ascent aids according to the invention with a step TS, and therefore a rail vehicle driver as operating staff has access to each of the driver's cabs FS1, FS2 from each side of the rail vehicle SFZ and can safely and easily climb up to or can climb down from the driver's cab FS1, FS2.

The step TS has a width BR and a step depth TT that are defined for safe use by the rail vehicle driver.

The step TS of elongated design with the width BR has two ends in the longitudinal direction.

At a first end of the step TS, the latter is connected to a first folding mechanism KMER, which is designated "folding mechanism, folded-in, latching" and is explained in detail in the following figure FIG. 2.

At a second end of the step TS, the latter is connected to a second folding mechanism KMAR which is designated "folding mechanism, unfolded, latching" and is explained in detail in the following figure FIG. 3.

Figure 2:
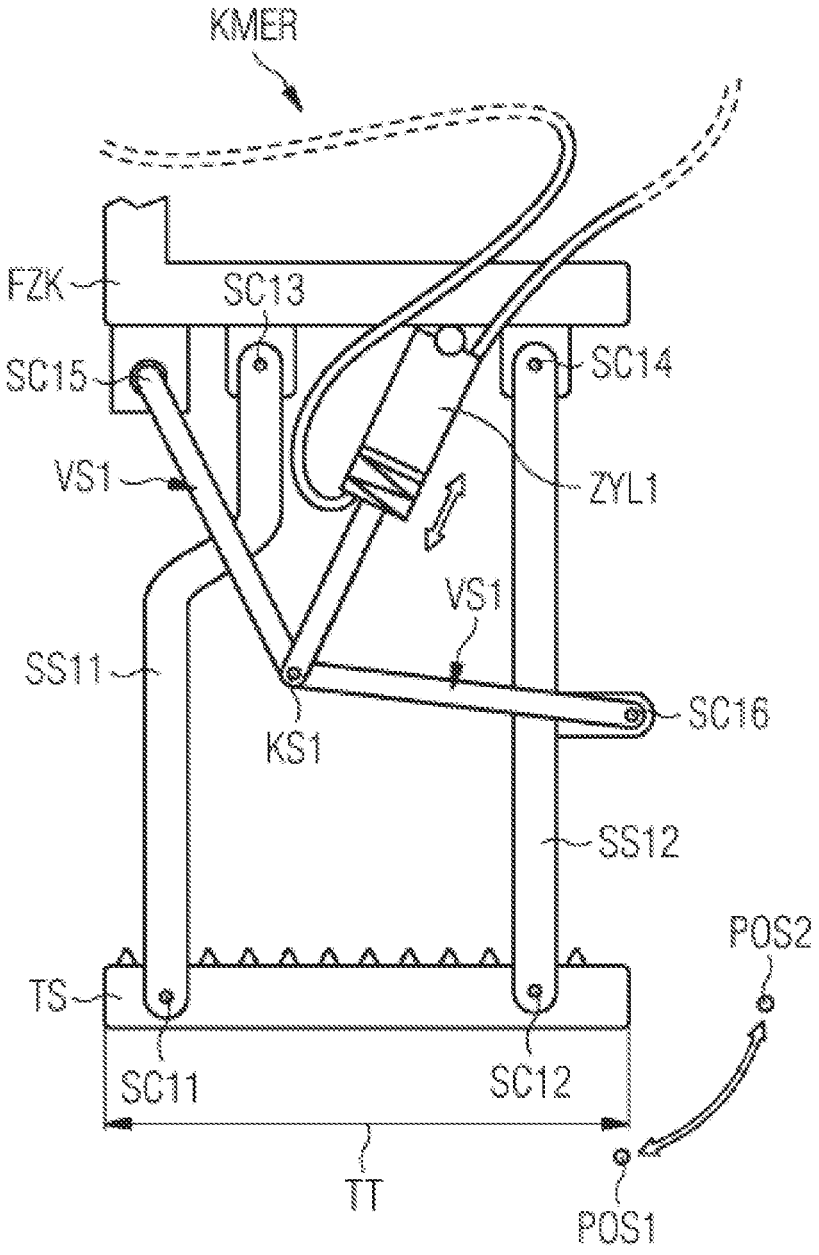
FIG. 2 shows, with respect to FIG. 1, the ascent aid according to the invention in a first view.

FIG. 2 shows, with respect to FIG. 1, the ascent aid according to the invention in a first view A-A with the first folding mechanism KMER ("folding mechanism, folded-in, latching").

The step TS is shown here in a transverse view with its step depth TT.

The step TS, as seen in the longitudinal direction, is connected at its first end to the respective lower end of two lateral rods SS11, SS12. This connection is undertaken via two hinges SC11 and SC12.

The two lateral rods SS11, SS12 are connected at their respective upper end to the vehicle body FZK of the rail vehicle SFZ. This connection takes place via two hinges SC13 and SC14.

The second lateral rod SS12 is additionally connected to the vehicle body FZK via a connecting rod VS1. This connection also takes place via two hinges SC15 and SC16.

The connecting rod VS1 is split into two parts by a folding hinge KS1. The folding hinge KS1 here preferably has a stop which forms a mechanical boundary for the movement of the folding hinge KS1 and therefore constitutes part of a lock described below.

By means of action of force on the folding hinge KS1 and by means of the hinges SC11 to SC16, the step TS is mounted rotatably or arranged foldably between a first position POS1 and a second position POS2.

In the first position POS1 of the step TS, an ascent (for example of a rail vehicle driver) to the driver's cab FS1 of the rail vehicle SFZ is assisted; the step is accordingly and with reference to the rail vehicle virtually "unfolded".

In the second position POS2, the step TS is folded away inward and upward with respect to the rail vehicle SFZ such that a predetermined clearance gauge of the rail vehicle SFZ is maintained. The clearance gauge is selected in such a manner that collisions of the step TS with installations close to the track are avoided during travel of the rail vehicle SFZ.

The action of force on the folding hinge KS1 causes the step TS to thus be unfolded or folded in transversely with respect to the longitudinal direction of the rail vehicle SFZ between the positions POS1 and POS2 via a rotational movement.

The action of force on the folding hinge KS1 takes place via a first cylinder ZYL1 of a cylinder drive, which cylinder is connected both to the folding hinge KS1 and to the vehicle body FZK. A further hinge is preferably provided for this purpose on the vehicle body.

In the position POS1 illustrated here (step TS is "unfolded"), the first cylinder ZYL1 of the cylinder drive is extended (for example maximally) and the connecting rod VS1 has a bend.

In the second position POS2 (step TS is "folded in"), the first cylinder ZYL1 would be retracted and the connecting rod VS1 would be straightened or straight. In this state, the folding mechanism described here would lock at the folding hinge KS1 using the stop, thus explaining the designation "KMER=folding mechanism, folded in, latching".

Figure 3:
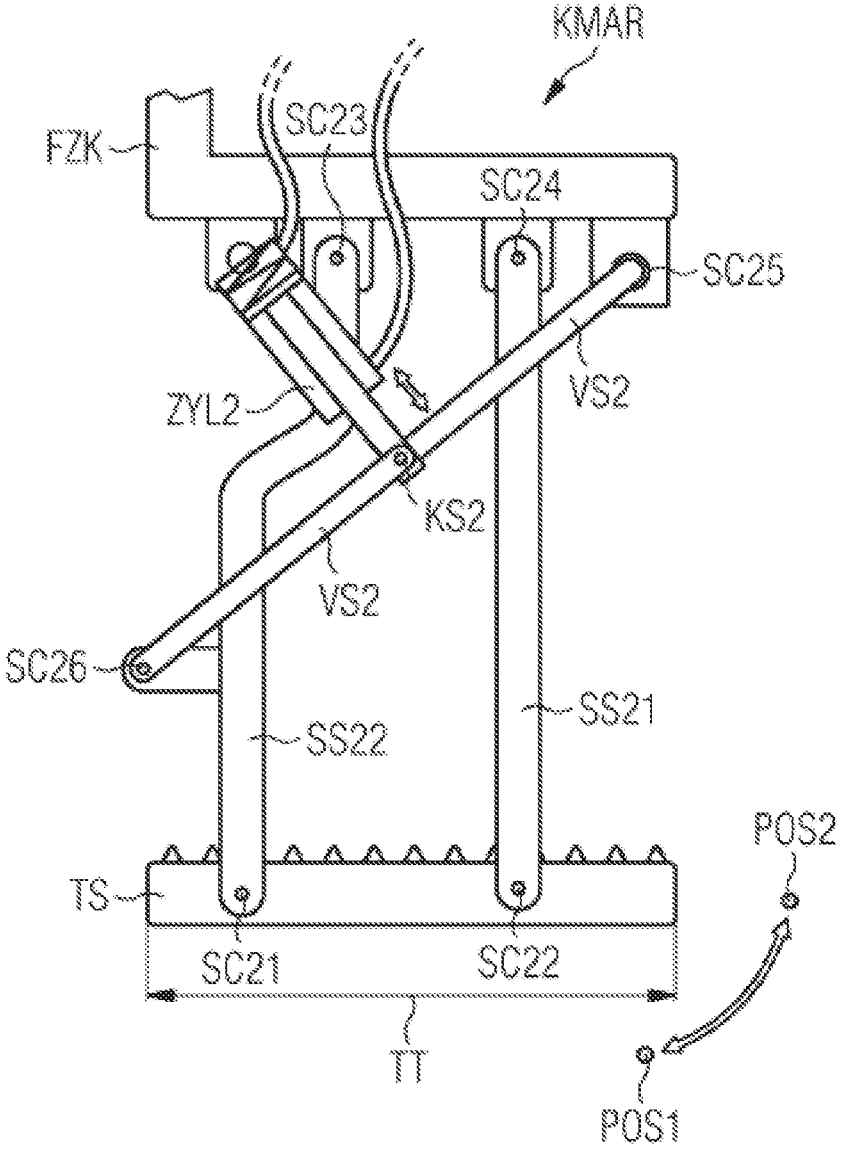
FIG. 3 shows, with respect to FIG. 1, the ascent aid according to the invention in a second view.

FIG. 3 shows, with respect to FIG. 1, the ascent aid according to the invention in a second view B-B with the second folding mechanism KMAR ("folding mechanism, unfolded, latching").

The step TS is shown here in a transverse view with its step depth TT.

The step TS, as seen in the longitudinal direction, is connected at its second end to the respective lower end of two side rods SS21, SS22. This connection takes place via two hinges SC21 and SC22.

The two lateral rods SS21, SS22 are connected at their respective upper end to the vehicle body FZK of the rail vehicle SFZ. This connection takes place via two hinges SC23 and SC24.

The second lateral rod SS22 is additionally connected to the vehicle body FZK via a connecting rod VS2. This connection also takes place via two hinges SC25 and SC26.

The connecting rod VS2 is split into two parts by a folding hinge KS2. The folding hinge KS2 here preferably has a stop which forms a mechanical boundary for the movement of the folding hinge KS2 and is therefore part of a lock described below.

By action of force on the folding hinge KS2 and by means of the hinges SC21 to SC26, the step TS is mounted rotatably or arranged foldably between the first position POS1 and the second position POS2.

In the first position POS1 of the step TS, as described above, the ascent to the driver's cab FS1 of the rail vehicle SFZ is assisted; the step is expediently and, with respect to the rail vehicle, virtually "unfolded".

In the second position POS2, the step TS is folded away inward and upward with respect to the rail vehicle SFZ such that a predetermined clearance gauge of the rail vehicle SFZ is maintained. The clearance gauge is selected in such a manner that collisions of the step TS with installations close to the track are avoided during the journey of the rail vehicle SFZ.

The action of force on the folding hinge KS2 causes the step TS to therefore be unfolded or folded in transversely with respect to the longitudinal direction of the rail vehicle SFZ between the positions POS1 and POS2 via a rotational movement.

The action of force on the folding hinge KS2 takes place via a second cylinder ZYL2 of a cylinder drive, which cylinder is connected both to the folding hinge KS2 and to the vehicle body FZK. A further hinge is preferably provided for this purpose on the vehicle body.

In the position POS1 illustrated here (step TS is "unfolded"), the second cylinder ZYL2 of the cylinder drive is retracted (for example maximally) and the connecting rod VS2 is straightened, i.e. does not have a bend. In this state, the folding mechanism described here is locked at the folding hinge KS2 using the stop, and therefore the designation "KMAR=folding mechanism, unfolded, latching" is explained.

In the second position POS2 (step TS is "folded in"), the second cylinder ZYL2 would be extended and the connecting rod VS2 would then have a bend.

Figure 4:
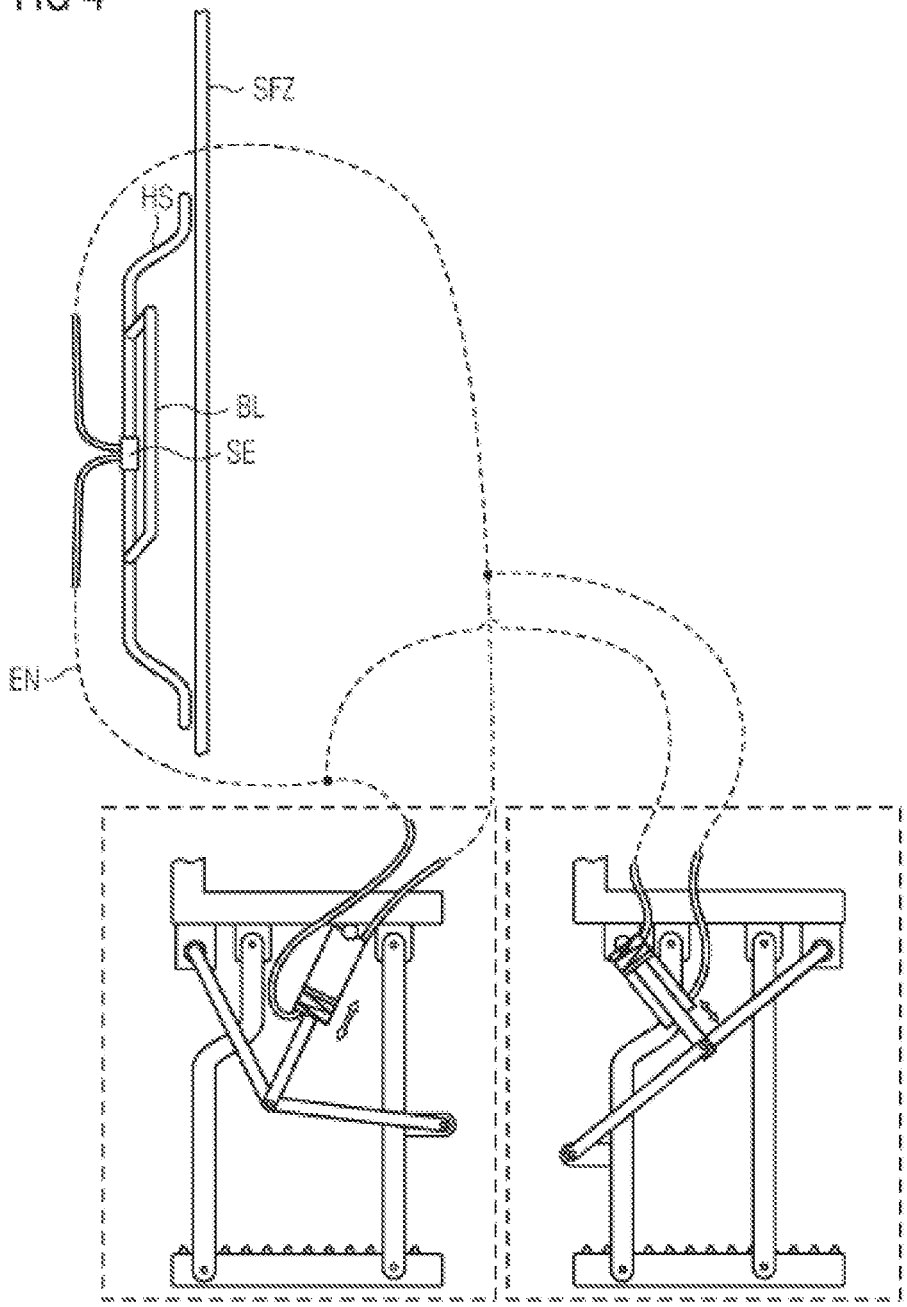
FIG. 4 shows, with respect to the figures FIG. 1 to FIG. 3, an advantageous development of the ascent aid according to the invention.

FIG. 4 shows, with respect to the figures FIG. 1 to FIG. 3, an advantageous development of the ascent aid according to the invention.

A hand rail HS which assists the safe ascent of the operating staff is arranged here on the rail vehicle SFZ. The hand rail HS here comprises an integrated actuating mechanism BL, SE with which the two cylinders ZYL1, ZYL2 of the cylinder drive are controlled.

Pressure lines for the cylinders ZYL1, ZYL2 are controlled via a switch EN which is an integrated part of the hand rail HS.

The switch EN is preferably part of an actuating strip which is integrated in the hand rail HS.

The actuating strip is configured structurally in such a manner that it can be operated both in an upper region (i.e. when the rail vehicle driver leaves the driver's cab) and in the lower region (i.e. when the rail vehicle vehicle driver is standing on the track bed).

The actuating strip preferably activates the switching element SE which is configured, for example, as a pneumatic valve. The step TS is extended via the pressure lines into the first position POS1, but only until the rail vehicle driver has one hand on the hand rail HS with the actuating strip BL.

If, by contrast, the rail vehicle driver releases the hand rail HS with the actuating strip BL, the step TS retracts with a time delay until the position POS2 has been reached.

The time delay is necessary because, in the event of an inadvertent, short release of the actuating strip BL, the step TS should not immediately retract, in order to prevent accidents.

In summary, the arrangement according to the invention has the following operating characteristics:

When getting on or off, the vehicle driver actuates the actuating strip BL. The switching element SE is thereby activated and the pressure chamber of the cylinder ZYL1 and also the pressure chamber of the cylinder ZYL2 are subjected to pressure (for example by means of air or oil).

The second cylinder ZYL2 retracts, the first cylinder ZYL1 extends and the two cylinders ZYL1, ZYL2 thus push the step TS into the extended position POS1.

The second cylinder ZYL2 moves against the stop of the folding hinge KS2 and blocks the unfolding movement. The associated foldable connecting rod VS2 is straightened.

The step TS is extended with audible hissing noises. The vehicle driver can safely climb onto the step TS.

The step TS acts here in a stable manner because the second connecting rod VS2 is straightened.

If the vehicle driver has got on or off, said driver releases the hand rail HS with the actuating strip BL. The pressure sides of the cylinders ZYL1, ZYL2 are slowly vented by means of a throttle (not illustrated). It is thereby ensured that, when the actuating strip BL is inadvertently released, the step does not immediately retract, but rather retracts with a time delay.

The (optionally pneumatic) hissing noise would draw the vehicle driver's attention to the fact that the vehicle driver is no longer keeping the actuating strip BL pressed, and the vehicle driver will instinctively press tighter with the hands in order to again correctly activate the actuating strip BL.

If the vehicle driver has intentionally released the actuating strips BL, the pressure sides of the cylinders ZYL1, ZYL2 are slowly vented and the pressure sides of the cylinders ZYL1, ZYL2 having a spring are ventilated.

The first cylinder ZYL1 retracts slowly and the second cylinder ZYL2 extends slowly. As a result, the step TS is slowly retracted and brought into the second position POS2.

The first cylinder ZYL1 moves against the stop of the folding hinge KS1 and fixes the step TS in the retracted state by the associated connecting rod VS1 being straightened.

The arrangement according to the invention has fail-safe functionality. In the event of line breakages and the pressure loss associated therewith, the respective springs in the cylinders ZYL1, ZYL2 press the step TS into the position POS2.

Figure 5:
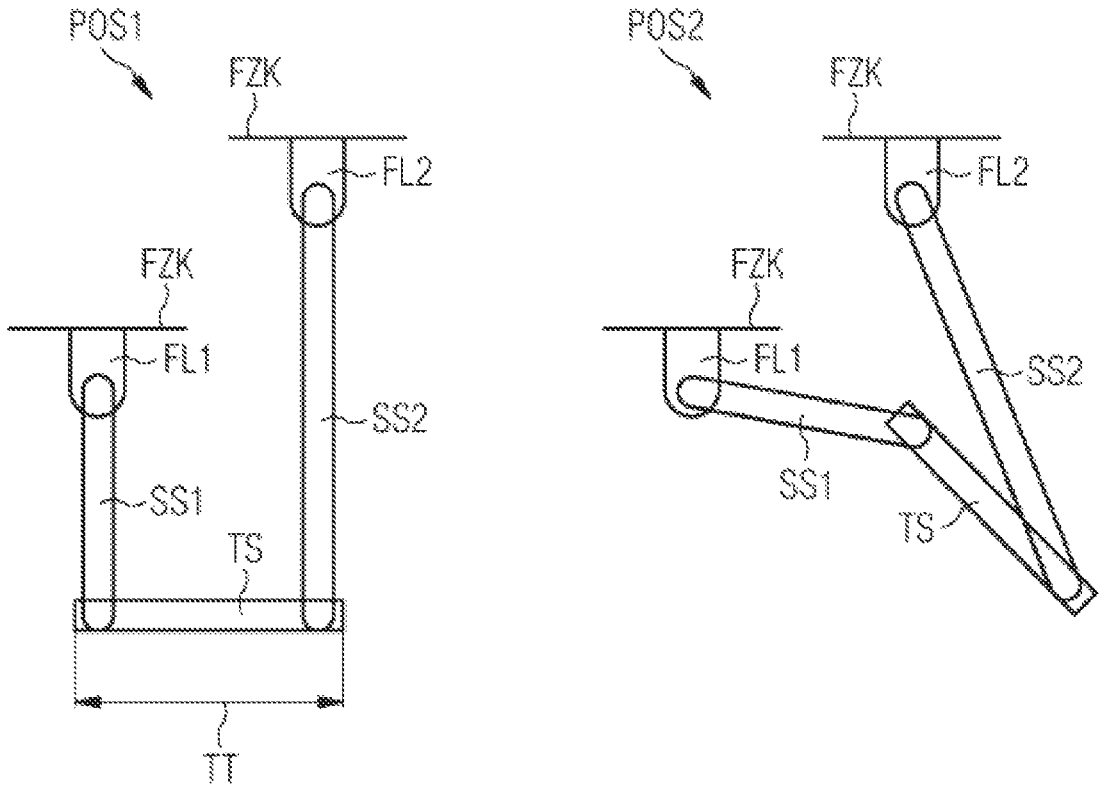
FIG. 5 shows an alternative configuration of the ascent aid according to the invention in a schematic illustration.
Figure 6:
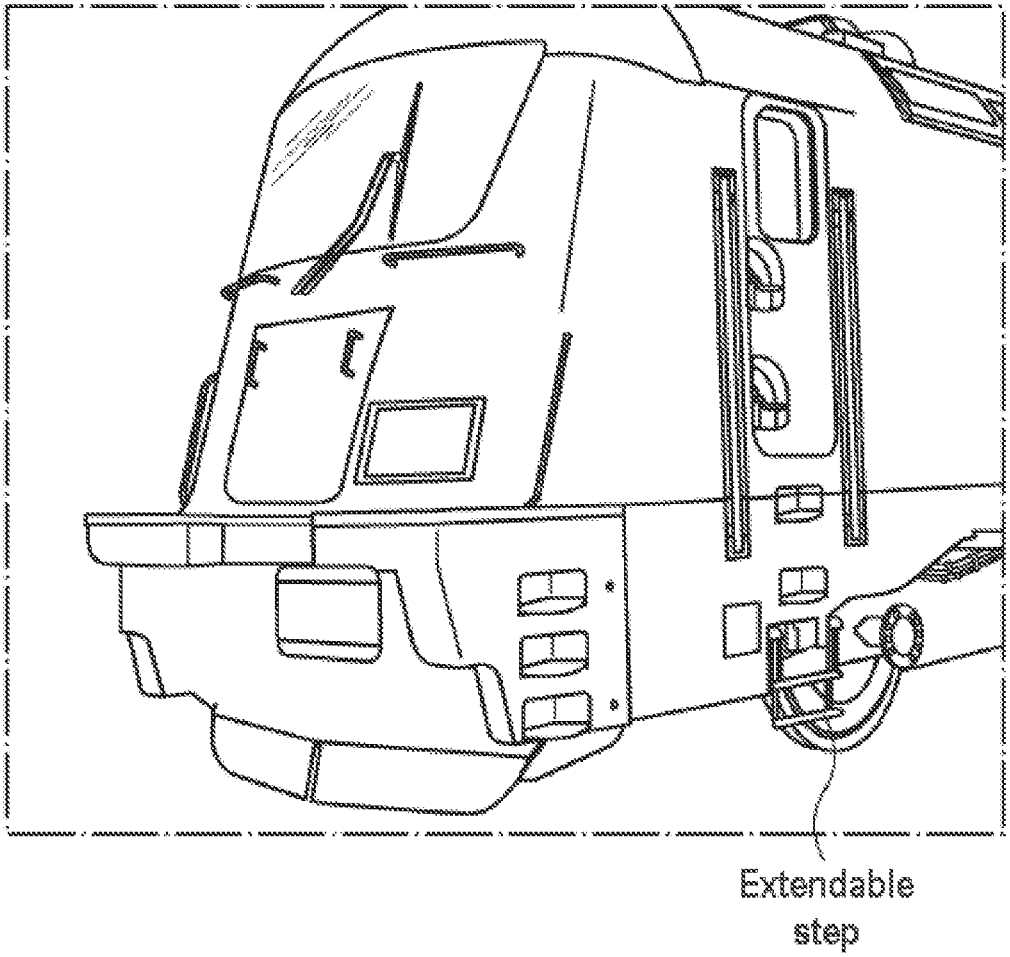
FIG. 6 PRIOR ART
FIG. 6 shows the prior art described in the introduction.

FIG. 5 shows an alternative configuration of the ascent aid according to the invention in a schematic illustration.

The step again moves here between a first position POS1 (unfolded position) and a second position POS2 (folded in position).

The embodiment according to the figures FIG. 1 to FIG. 4 describes a folding in or unfolding of the step TS that is achieved by means of a rotational movement of parallel lateral rods.

If said parallel guidance is not possible for structural reasons, the movement of the step TS that is illustrated in this figure FIG. 5 comes into consideration.

In this side view, the step TS is connected to the vehicle body FZK again via lateral rods SS1, SS2 and via hinges or bearings FL1, FL2.

The movement is carried out expediently and with respect to the above embodiments via cylinders (not illustrated here).

The invention claimed is:

1. An ascent aid for a rail vehicle having a vehicle body, a driver's cab and a step, the ascent aid comprising:

a first folding mechanism fastened to a first end of the step, as seen in a longitudinal direction of the step;

a second folding mechanism fastened to a second end of the step opposite to the first end of the step, as seen in the longitudinal direction of the step;

each of said folding mechanisms having two respective lateral rods;

said two lateral rods having respective lower ends connected by respective hinges to the step, and said two lateral rods having respective upper ends connected by respective hinges to the vehicle body;

each of said folding mechanisms having a respective connecting rod additionally connecting one of said lateral rods by hinges to the vehicle body, and said one connecting rod being divided into two parts by a folding hinge;

said folding hinge being coupled to an action of force, said action of force on said folding hinge causing the step to be folded by said hinges between a first position and a second position relative to the rail vehicle, an ascent to the driver's cab of the rail vehicle being assisted in said first position of the step, and the step being folded in said second position to maintain a predetermined clearance gauge of the rail vehicle;

said first folding mechanism including a first cylinder for providing said action of force, said first cylinder having one end connected to said folding hinge of said connecting rod and another end connected to the vehicle body, said first cylinder in said first position with the step unfolded being extended, causing said connecting rod to have a bend, and said first cylinder in said second position with the step folded in, being retracted causing said connecting rod to be straightened to lock said folding mechanism in said second position;

said second folding mechanism including a second cylinder for providing said action of force, said second cylinder having one end connected to said folding hinge of said connecting rod and another end connected to the vehicle body, said second cylinder in said first position with the step unfolded, being retracted causing said connecting rod to be straight to lock said second folding mechanism in said first position, and said second cylinder in said second position with the step folded in, being extended causing said connecting rod to have a bend; and said action of force on said folding hinges causing the step to be mounted so as to be foldable in a movement plane transversely relative to a longitudinal direction of the rail vehicle.

2. The ascent aid according to claim 1, wherein said first and second cylinders are connected and configured to rotate the step into said second position upon a drop in pressure in said first and second cylinders.

3. The ascent aid according to claim 2, wherein said rotation into said second position after the drop in pressure is realized with a time delay.

4. The ascent aid according to claim 1, wherein said first and second cylinders are part of a pneumatic or hydraulic or electric cylinder system.

5. The ascent aid according to claim 1, which further comprises:

a hand rail disposed on the rail vehicle, said hand rail assisting a safe ascent of operating staff to the driver's cab; and said hand rail including an integrated actuating mechanism controlling said action of force.

6. The ascent aid according to claim 1, wherein the step is mechanically blocked both in said first position and in said second position.

* * * * *